United States Patent [19]

Schick et al.

[11] 4,074,003

[45] Feb. 14, 1978

[54] THERMOGRAPHIC STENCIL SHEET, ASSEMBLY AND METHOD OF MAKING AN IMAGED STENCIL SHEET

[75] Inventors: Margery L. Schick, Mount Prospect; Bror E. Anderson, Arlington Heights, both of Ill.

[73] Assignee: Weber Marking Systems, Inc., Arlington Heights, Ill.

[21] Appl. No.: 685,324

[22] Filed: May 11, 1976

Related U.S. Application Data

[63] Continuation of Ser. No. 521,033, Nov. 5, 1974, abandoned.

[51] Int. Cl.[2] ..... B41N 1/24

[52] U.S. Cl. ..... 428/341; 282/27.5; 427/143; 428/342; 428/913

[58] Field of Search ..... 428/913, 480, 511, 535, 428/340, 341, 342; 427/143, 148; 250/318, 475; 280/27.5

[56] References Cited

U.S. PATENT DOCUMENTS

| | | | |
|---|---|---|---|
| 3,682,763 | 8/1972 | Kubo et al. | 101/128.2 |
| 3,694,245 | 9/1972 | Anderson et al. | 250/65 T |
| 3,924,041 | 12/1975 | Miyayama et al. | 428/913 |
| 3,978,247 | 8/1976 | Braudy et al. | 428/913 |

*Primary Examiner*—George F. Lesmes
*Assistant Examiner*—Stanley S. Silverman
*Attorney, Agent, or Firm*—Gerlach and O'Brien

[57] ABSTRACT

A stencil sheet of the type including an ink-impervious coating of a heat-flowable composition on an ink-pervious base sheet includes at least two layers of the composition on the base sheet, one layer being adapted for imaging contact with an original and essentially colorless, and the remaining layer being adapted for contact with a sheet receiving fluid material from image openings formed in the coating upon imaging, the remaining layer containing coloring material providing a visible index of the degree of imaging on the receiving sheet.

13 Claims, No Drawings

THERMOGRAPHIC STENCIL SHEET, ASSEMBLY AND METHOD OF MAKING AN IMAGED STENCIL SHEET

This is a continuation, of application Ser. No. 521,033, filed Nov. 5, 1974, now abandoned.

BACKGROUND OF THE INVENTION

This invention relates to an assembly of a thermographic stencil sheet of the type which includes an ink-impervious coating of a heat-flowable composition on an ink-pervious base sheet, and a receiving sheet, and to a method of making an imaged stencil sheet with the assembly by subjecting image areas of the stencil sheet to heat generated by infrared ray absorption.

A thermographic stencil sheet including an ink-pervious base sheet and an ink-impervious coating thereon of a heat-flowable composition of thermoplastic film-forming material comprising a cellulose organic ester, and plasticizing material partially but incompletely compatible with the film-forming material is disclosed in various embodiments in U.S. Pat. Nos. 3,694,244, 3,694,245, 3,704,155, 3,824,116 and 3,824,117. The stencil sheet now is in widespread commercial use. It is employed preferably in a stencil sheet assembly including a contacting receiving or absorbent sheet on one surface thereof, and a more rigid backing sheet on the opposite surface thereof and to which the receiving sheet and the stencil sheet are mounted. In use, an original, such as a typed or printed sheet, is inserted between the stencil sheet and the backing sheet, and the assembly is exposed to infrared radiation on the face side of the receiving sheet in a thermocopier such as a Weber Thermal Imager (Weber Marking Systems) or a Thermo-Fax machine (3M Company), whereby the stencil sheet is imaged. Heat is generated in the radiation absorptive graphic portions of the original during imaging, to cause the stencil sheet composition to flow in corresponding areas and thereby produce corresponding image openings in the stencil sheet. A portion of the composition rendered flowable adheres to and/or is absorbed by the receiving sheet and/or adjoining areas of the stencil sheet. The original and the receiving sheet are separated from the imaged stencil sheet, the stencil sheet and the backing sheet are placed on a mimeograph duplicating machine followed by a separation of the backing sheet, and the machine is operated to produce multiple mimeograph copies of the original.

Copies of the best quality are produced from stencils which have been imaged at their optimum imaging speeds or exposure times. Optimum imaging speed is, however, subject to variations in infrared ray absorptivity of the original variation among stencils of different composition, variation from lot to lot of stencils of a given composition, and variation with different machines and power supplies. Consequently, it is necessary or preferable to establish the optimum imaging speed under each new set of conditions. Prior to the present invention, stencils have been evaluated for degree of imaging for the most part by placing them on a mimeograph machine and running off copies. They may be evaluated by holding them up to the light after removing the original, but it then is no longer possible to rerun an under-exposed stencil, and a certain amount of proficiency is required in order to evaluate the stencil without making copies therefrom. Consequently, a need exists for a better method of proofreading a stencil for the degree of imaging, or of determining the optimum setting on an imager.

SUMMARY OF THE INVENTION

The present invention provides an assembly for making an imaged stencil sheet and adapted to provide a visual index of the degree of imaging, which assembly comprises a thermographic stencil sheet and a receiving sheet arranged for surface contact with the stencil sheet, the stencil sheet including an ink-pervious base sheet, and at least two layers of a heat-flowable composition providing an ink-impervious coating on the base sheet, one of the layers being adapted for imaging contact with an original and essentially colorless, and the remaining one of said layers being adapted for contact with the receiving sheet, the latter receiving fluid material from image openings formed in the coating upon imaging, the remaining layer containing coloring material sufficient to provide a visible index of the degree of imaging on the receiving sheet but insufficient to substantially increase the infrared absorptivity of the stencil sheet. The heat-flowable composition preferably includes a thermoplastic film-forming material comprising a cellulose organic ester, and plasticizing material partially but incompletely compatible with the film-forming material, as disclosed in the above-identified patents.

The invention also provides a method of making an imaged stencil sheet employing the new assembly.

Employing the stencil sheet assembly of the invention, the exposed surface of the receiving sheet may be inspected immediately following imaging, for evaluation by the operator of the degree of imaging. If the stencil sheet has been under-exposed, it may be reexposed at a slower machine setting to produce the proper degree of imaging. If the stencil sheet has been over-exposed, it may be discarded without taking the time to test it on a mimeograph machine. Economies may be effected by testing small segments of a stencil sheet at several imager settings. Where an approximate estimate can be made, the stencil may be first run at what is believed to be a fast setting. If the initial estimate is correct, the stencil can be rerun at a slower setting. If the initial estimate was of a slower stencil sheet than turns out to be the case, the initial fast setting may be adequate.

The foregoing evaluation and rerunning of the stencil sheet take place while the complete assembly of stencil sheet, backing sheet, original, and receiving sheet are intact, although in a less preferred procedure, described hereinafter, the receiving sheet may be raised while the remaining members remain intact. In either case, when the stencil sheet is determined to be imaged as desired, the original may be removed and accurately replaced by a second original, for additional imaging, or further copy may be added to the stencil sheet by other techniques. The entire process takes place without need for making copies on a mimeograph machine, frequently to learn that the image could or should be improved and a new stencil would be required to achieve that objective.

Surprisingly, a visible index of the degree of imaging may be provided on the receiving sheet in accordance with the invention, without at the same time substantially reducing the quality of the stencil and the copies made therewith. Thus, the use of a coloring material in a heat-flowable composition layer subjected to infrared radiation is fraught with the possibility that radiation absorbed by the coloring material and converted into heat energy will harm the stencil. Proceeding according to the invention, however, this possibility has been obviated in a surprising manner, by interposing another layer between the layer containing the coloring material and the original, which interposed layer contains essentially no coloring material.

In the preferred embodiments of the invention, a secondary objective is achieved, of avoiding transfer of coloring material to the original. At times, where the original is to be preserved, it is undesirable that the original be colored. At other times, when the original is to be disposed of following its use for the purpose of making a stencil, it is of no consequence that the original is colored by the stencil sheet.

DESCRIPTION OF THE PREFERRED EMBODIMENTS

The stencil sheet employed in the assembly of the invention includes a base tissue sheet that may be formed of any suitable fiber, such as abaca, wood, abaca and wood fibers, kozo, sisal, New Zealand flax, viscose rayon, polyester, or mixtures thereof, loosely arranged to provide a foraminous, highly permeable tissue. The tissue may weigh about 4½ to 12 lbs. per 3,000 sq. ft. (24 × 36 inches, 500 sheets).

It is preferred to provide either two or three layers or coats of the heat-flowable coating composition, which is solid at ambient temperature. When employing two layers, it is preferred that the total weight of coating composition be about 18–23 lbs. (dry basis) per 3,000 sq. ft. When employing three layers, it is preferred that the third layer, which then is a colored outer layer, be applied at the rate of about 1–3 lbs. per 3,000 sq. ft., for a total coating weight of about 19–26 lbs. per 3,000 sq. ft.

There are several possible combinations of layers in the invention. Thus, in a stencil sheet having two layers, the coloring material may be applied in the first or in the second layer. Where the coloring material is applied in the first layer, it is preferred that such layer contain about 10–15 lbs. of composition per 3,000 sq. ft., and the second layer on one side thereof contain about 6–12 lbs. per 3,000 sq. ft. Where a third layer is employed, it contains the coloring material. It is provided on the opposite side to the second layer, in an amount of 1–3 lbs. per 3,000 sq. ft.

Alternatively, two layers may be employed on the base sheet, with the coloring material in the second layer. In such case, the first layer preferably is relatively heavy, about 15–22 lbs. per 3,000 sq. ft., and the second layer is relatively light, about 1–3 lbs. per 3,000 sq. ft., as in the three-layer embodiment. The advantages of employing the coloring material in a light second or third layer are that less coloring material is required, better stencil quality is achieved, and coloration of the original is obviated or minimized. Another advantage of employing the three-layer stencil, and an advantage of employing the two-layer stencil with the second layer essentially colorless, is that the second layer may be applied to one surface of the first layer so as to fill in the low areas of the surface of the first layer and provide an even surface on the resulting stencil sheet, for intimate contact with an original. The advantages achieved thereby include faster imaging and wider latitude in imaging time. This improvement forms the subject matter of the copending application of the same inventors entitled "Thermographic Stencil Sheet and Method of Making an Imaged Stencil Sheet", Ser. No. 521,034 filed on November 5, 1974 (Case 1).

The heat-flowable coating composition preferably is of the type described in the patents identified above. However, the principles of the invention are applicable to other types of heat-flowable compositions. It is further preferred to employ a coating composition including a thermoplastic polymeric hydrocarbon resin and/or an alkylene oxide ester or ether, as disclosed in U.S. Pat. Nos. 3,824,116 and 3,824,117. It is preferred that the coating composition melt at a temperature of at least about 65° C., preferably in the range of about 65°–180° C., more preferably, about 90°–160° C. (a coating composition melting point as referred to herein is determined as the temperature at which the composition on a stencil sheet visibly melts or liquefies). Inasmuch as the preferred compositions of the latter patents are fully disclosed therein, it is believed to be unnecessary to repeat the disclosure thereof herein, but such disclosure is incorporated herein by reference.

The layers of heat-flowable composition preferably are solvent-deposited on the base sheet, as described for the preferred embodiments in the foregoing patents, for example. Depending upon the quantity to be deposited, the coating composition materials may be incorporated by mixing in a solvent mixture at a concentration of about 20–35% by weight in the preferred embodiments, also as described in the foregoing patents. In the examples which follow, the coating compositions were formulated in a solvent mixture of (in parts by weight) 50 parts of toluene, 36 parts of ethyl acetate, and 14 parts of anhydrous isopropanol.

The formula of the coating composition can be varied in the respective layers, so long as the properties of the layers do not change significantly on standing over the desired shelf life, due to migration of ingredients from one layer to the other. Thus, the respective layers may be formulated so as to provide better durability, less tackiness, better oil transfer properties, and other characteristics which may be preferred for one layer or the other. A specific example of a variation which may prove to be advantageous is the use of silica gel in one layer, to reduce tackiness, while omitting the same from another layer or layers, for better imaging properties. The use of silica gel is disclosed in U.S. Pat. No. 3,694,244.

The outer layer, adapted for contact with the receiving sheet, is heavily colored with coloring material sufficient to provide a visible index of the degree of imaging on the receiving sheet but insufficient to substantially increase the infrared absorptivity of the stencil sheet. The coloring material may be a pigment or a dye having relatively low infrared absorptivity. Exemplary pigments include Dianisiline Blue, Carbazole Violet, Phthalo Green, Phthalo Blue, and Indanthrone Blue. Exemplary dyes include Orasol (Irgacet) Yellow 2GL and Blue 2GLN. The pigments are preferred, as requiring less material and having less tendency to color the original.

The coloring material preferably is sufficient in strength and quantity to transfer a legible image to an absorbent tissue receiving sheet, the legibility of the image correlating with the legibility of copy produced employing the imaged stencil sheet. In such case, the image transferred to the receiving sheet is substantially solid or continuous and unbroken, looking like the image on the copy produced with the stencil sheet, when the stencil sheet has been imaged about at the optimum imaging speed. When the stencil sheet has been under-exposed, the image will appear broken, or no image may be formed on the receiving sheet. When the stencil sheet has been over-exposed, letter centers and the like will be filled in. Such results are obtained with the absorbent tissue receiving sheets in current use. Other receiving sheets which may be employed, and which are designed to prevent transfer of fluid material therebeyond to equipment surfaces, may have less absorptivity and not function as well in this respect as absorbent tissue. However, the strength of the color of the image transferred to the receiving sheet alone may be employed by an experienced operator as an index of the degree of imaging.

In general, the minimum level at which the coloring material may be employed, and then preferably in a light or thin second or third layer, is about 0.015 to 0.03 lb. per 3,000 sq. ft., depending upon color strength, with the pigment minima being lower than the dye minima. The maximum concentration of coloring material, in general, preferably is about 0.05 to 0.07 lb. per 3,000 sq. ft., with the higher values applicable to a light or thin second or third layer, and the lower values applicable to the two-layer sheet when the coloring material is in the first layer. It will be understood that the optimum quantities will vary depending upon the color strength of the coloring material, infrared absorptivity of the coloring material, and layer arrangement and quantity of composition in each layer.

Heretofore, single layer thermographic stencil sheets had been tinted with a pigment or a dye, to improve their visibility and/or appearance. The tinted compositions were inadequate to transfer color to the receiving sheet in strength sufficient to provide a visible index of the degree of imaging on the receiving sheet. Also, the presence of a color layer adjacent to the original resulted in a tendency to transfer color to the original. Increasing the color concentration in a single layer stencil sheet was found to reduce the image quality to an unacceptable extent.

The pigments are incorporated in the coating compositions in suitable grinds, and other ingredients of the compositions may serve as vehicles. Illustrative vehicles are indicated together with the identification of individual pigments hereinafter. The dyes may be dissolved in the solvents employed for the compositions.

The base tissue sheet may be coated by any suitable applicator, and excess composition is removed by suitable means, such as a doctor rod. The first layer may be dried by air at ambient temperature or by warm air. Subsequent layers preferably are dried rapidly, with heated, circulated air, so as to minimize any effect of the solvent on the preceeding layer. The stencil sheet is dried between applications at least sufficiently to be about dry to the touch, and so that the composition will not be removed from the sheet by guide rolls and the like. Ultimately, the stencil sheet is dried to a volatiles content below about 0.5% by weight.

The receiving sheet, which receives fluid composition from the stencil sheet, may be an absorbent sheet similar to the base tissue sheet. Thus, a tissue sheet may be employed which weighs about 4½ to 15 lbs. per 3,000 sq. ft., and is formed of a suitable fiber, such as abaca, wood, abaca and wood fibers, kozo, sisal, New Zealand flax, viscose rayon, polyester, or mixtures thereof, loosely arranged to provide a foraminous, permeable tissue. Alternatively, the receiving sheet may form a barrier to transfer of fluid composition therethrough, in addition to receiving fluid composition. Thus, a laminar sheet of absorptive and impermeable materials may be employed, for use with the absorptive surface next to the stencil sheet during imaging. The absorptive material may be formed of the foregoing fibers. An exemplary impermeable material is a plastic sheet material with a melting point high enough to withstand the temperature conditions, for example, a polyester film such as polyethylene terephthalate. In another alternative, a barrier may be provided by a layer or lamina of tightly compacted fibers.

The receiving sheet preferably provides a contrasting background for the colored fluid material received thereon, while affording viewability thereof with the assembly intact following imaging. For example, an absorbent sheet formed of the foregoing fibers may provide a white background which contrasts with the colored composition thereon, while affording viewability due to the permeation of the fluid material. At the same time, the remainder of the receiving sheet tends to obscure the body of the stencil sheet, not rendered fluid and therefore not permeating the absorbent sheet. Alternatively, it is possible to employ a clear receiving sheet, but in order to afford contrast for evaluating the material transferred to the receiving sheet, it is necessary to separate the receiving sheet following imaging, and insert a contrasting sheet behind the receiving sheet.

Employing an absorbent sheet material for the receiving sheet as described above, a legible image is formed on the receiving sheet, which correlates with the legibility of the ultimate copy, as noted above. Consequently, less skill is required to determine when the stencil sheet is properly imaged. When employing a receiving sheet of less permeability, particularly when a barrier to fluid transfer is provided, the absorptivity and penetration of the fluid composition into the receiving sheet may at times be reduced, so that the legibility of the image is reduced, but the color strength exhibited by the transferred fluid composition yet may be employed by an experienced operator as a sufficient visual index of the degree of imaging.

Stencil imaging as reported in the examples was tested by mounting the stencil on a 63 lb. unoiled backing sheet. A porous absorbent tissue sheet was mounted over the stencil, the sheet being a 10 lb. per 2,880 sq. ft. tissue formed of abaca and wood pulp fibers (Grade 55 tissue, Dexter Corporation). Offset or typed originals were inserted between the stencil and the bakcing sheet for imaging on a Weber Thermal Imager Model No. 511 or a Thermo-Fax Model 45CG "Secretary" machine. Stencils were printed on a Weber Model 50 (Weber Marking Systems) label printer type of mimeograph stencil duplicating machine.

Illustrative materials which may be employed to provide the heat-flowable composition are disclosed in the above-identified patents. Materials which are employed in the examples herein are described as follows:

Cellulose Ester

CAB 500-1 is cellulose acetate butyrate grade EAB 500-1 (Eastman Chemical Products) having an average butyryl content of 49.6%, an average acetyl content of 5.5%, a hydroxyl content of 0.1–0.7%, a viscosity of 0.8–1.2 seconds (ASTM method D-1343-54T in Formula A, ASTM method D-871-54T), and a melting point range of about 165°–175° C.

Silica Gel

Syloid 255 (Davison Division, W. R. Grace Company) is silica gel having an oil absorption of about 315 lbs./100 lbs., a particle size range of 0.8–12 microns (90%), and an average particle size of about 3–4 microns.

Plasticizing Material

Mobilsol L (Socony Mobil Oil Co.) is a refined naphthenic petroleum oil having a viscosity of 61 Saybolt seconds (SUS) at 38° C., a straight aniline point of 74° C., an API gravity of 25.7°, and a distillation range of 254°–270° C. (100%).

Univolt 33 (Exxon Corporation) is a naphthenic petroleum oil having a viscosity of 59 Saybolt seconds at 38° C. and 34.2 Saybolt seconds at 99° C., a straight aniline point of 65.5° C., and a flash point (Cleveland) of 154.5° C.

Cumar R-9 (Neville Chemical Co.) is a coumarone-indene resin, described in U.S. Pat. No. 3,824,116, having a softening point of 111.5° C., a specific gravity at 25° C. of 1.141, an iodine number of 51.2, a mixed aniline point of 46.8° C., a molecular weight of 613, a viscosity of 1 poise at 195° C. and 10 poises at 159° C., and a refractive index at 25° C. of 1.632.

Brij 92 (ICI America) is polyoxyethylene ether of oleyl alcohol (2 moles of ethylene oxide) having an HLB (Atlas Hydrophile-Lipophile Balance) of 4.9, an acid number of 1.0 max., and a hydroxyl number of 160–180. It has a typical viscosity of approximately 30 centipoises at 25° C. (ASTM No. D445–53T), and a theoretical mixed aniline point of −2.8° C. (determined as in U.S. Pat. No. 3,824,116).

Hercolyn D (Hercules, Inc.) is a hydrogenated methyl ester of rosin purified by steam distillation, a liquid having a Gardner-Holdt viscosity at 25° C. of Z2–Z3 and an acid number of 7. Its mixed aniline point is 58° F.

Coloring Material

Carbazole Violet, LC7251 (Podell Industries), 23% pigment in castor oil vehicle.

Phthalo Blue, C6128 (Podell Industries), 15.0% pigment in castor oil vehicle.

Orasol (Irgacet) Blue 2 GLN and Yellow 2 GL (CibaGeigy Corporation).

Dianisidine Blue, LC6718 (Podell Industries), 9.1% pigment in vehicle of Brij 92 (54.5% of mixture) and castor oil (36.4%).

Phthalo Green C2341 (Podell Industries), 25% pigment in castor oil vehicle.

Antioxidants which may be included in the stencils include dilauryl thiodipropionate (DLTDP) and Plastanox 425, 2,2′-methylene-bis(4-ethyl-6-t-butylphenol). Preservatives which may be employed in the stencil sheet include butylated hydroxytoluene (BHT) and citric acid.

The following examples illustrate stencil sheets prepared and imaged according to the invention. It will be understood that the invention is not limited to the examples, which are merely illustrative, or to the materials, proportions, conditions and procedures set forth therein.

EXAMPLE 1

Stencil sheets were prepared from the following heat-flowable composition of thermoplastic film-forming material and plasticizing material partially but incompletely compatible with the film-forming material, deposited as a first layer on a base tissue sheet from the solvent described above at a concentration of 35% by weight:

Composition 1

| Material | Parts by Weight |
|---|---|
| CAB 500-1 | 17.0 |
| Cumar R-9 | 19.0 |
| Univolt 33 | 45.0 |
| Brij 92 | 19.0 |
| Syloid 255 | 2.6 |

The stencil sheets were completed by depositing one of the following heat-flowable compositions of thermoplastic film-forming material and plasticizing material partially but incompletely compatible with the film-forming material, as a second layer on the sheet, from the same solvent at a concentration of 22% by weight:

Composition 2

| Material | Parts by Weight |
|---|---|
| CAB 500-1 | 17.2 |
| Cumar R-9 | 18.0 |
| Univolt 33 | 46.2 |
| Brij 92 | 15.3 |
| Castor oil | 3.3 |
| Syloid 255 | 2.6 |

Composition 2 also contained 0.9 part by weight of Carbazole Violet, to provide for application of the pigment at a rate of 0.03 lb. per 3,000 sq. ft.

Composition 3

| Material | Parts by Weight |
|---|---|
| CAB 500-1 | 17.0 |
| Cumar R-9 | 17.6 |
| Univolt 33 | 45.8 |
| Brij 92 | 8.6 |
| Castor oil | 11.0 |
| Syloid 255 | 2.6 |

Composition 3 also contained 1.9 parts by weight of Phthalo Blue, providing for application of the pigment at a rate of 0.06 lb. per 3,000 sq. ft.

Composition 4

| Material | Parts by Weight |
|---|---|
| CAB 500-1 | 17.1 |
| Cumar R-9 | 17.6 |
| Univolt 33 | 45.7 |
| Brij 92 | 19.6 |
| Syloid 255 | 2.6 |

Composition 4 also contained 2.4 parts by weight of Orasol 2 GLN Blue, providing for application of the dye at a rate of 0.07 lb, per 3,000 sq. ft.

In each case, a base tissue sheet was employed which weighed 6.7 lbs. per 3,000 sq. ft. (Grade 251 tissue, Dexter Corporation). A clear first layer of the composition was applied by pulling the tissue from a roll across a rotating applicator roll picking up solution from a pan therebeneath.

Excess coating was removed by a doctor rod, and the coated sheet was dried to a residual solvent content below about 0.5% volatiles, by circulating low velocity air heated to about 130° F. The total coated weight of the single-coated sheet was 26.7 lbs. per 3,000 sq. ft., corresponding to an application of the coating composition in the first layer of 20 lbs. per 3,000 sq. ft.

The coating and drying procedures were repeated with the colored compositions, to deposit a second layer on each sheet, on one side of the first layer. The total coated weight of the stencil sheet having both layers thereon was 29.7 lbs. per 3,000 sq. ft., corresponding to 3 lbs. of composition deposited in the second layer per 3,000 sq. ft., and a total amount of composition deposited on the base tissue sheet of 23 lbs. per 3,000 sq. ft.

The stencil sheets were subjected to thermal imaging tests, as described above, with the first layer in contact with an original and the second layer in contact with an absorbent tissue receiving sheet. A good visible image was formed in the receiving sheet in each case, by colored composition absorbed in the fluid state upon imaging. The image was legible and correlated well with the legibility of copy produced with the stencil sheet. The quality of the stencil sheet image in each case was rated good when employing the Model 511 imager and fair when employing the Model 45CG imager. The original was not colored by the coloring material in any case.

EXAMPLE 2

A stencil sheet was prepared from the following two heat-flowable compositions of thermoplastic film-forming material and plasticizing material partially but incompletely compatible with the film-forming material:

Composition 5

| Material | Parts by Weight |
|---|---|
| CAB 500-1 | 19.5 |
| Cumar R-9 | 22.0 |
| Mobilsol L | 37.1 |
| Brij 92 | 19.1 |
| Castor oil | 1.7 |
| DLTDP | 0.1 |
| BHT | 0.1 |
| Plastanox 425 | 0.2 |
| Citric Acid | 0.2 |

Composition 6

| Material | Parts by Weight |
|---|---|
| CAB 500-1 | 19.9 |
| Cumar R-9 | 22.2 |
| Mobilsol L | 37.7 |
| Brij 92 | 19.5 |
| DLTDP | 0.1 |
| BHT | 0.1 |
| Plastanox 425 | 0.2 |
| Citric Acid | 0.3 |

Composition 5 also contained 0.4 part by weight of Dianisidine Blue, to provide for application at a rate of 0.05 lb. per 3,000 sq. ft. Composition 5 was employed for forming a first layer on a base tissue sheet, and was incorporated in the solvent described above at a concentration of 22% by weight for deposition on the sheet. Composition 6 was employed for providing a second layer on the sheet, in the above solvent at a concentration of 32% by weight.

The compositions were applied to the base tissue sheet described in Example 1. The first and second layers were applied in the manner described in Example 1, except that the first layer was dried only to the touch prior to application of the second layer. The double-coated sheet was dried to a residual solvent content below about 0.5% volatiles. The second layer filled the low areas on one surface of the first layer, and provided an even surface on the resulting stencil sheet for intimate contact with an original.

The total coated weight of the single-coated sheet was 20 lbs. per 3,000 sq. ft., corresponding to an application of Composition 5 in the first layer of 13.3 lbs. per 3,000 sq. ft. The total coated weight of the stencil sheet having both layers thereon was 28 lbs. per 3,000 sq. ft., corresponding to 8 lbs. of Composition 6 deposited in the second layer per 3,000 sq. ft., and a total amount of composition deposited on the base tissue sheet of 21.3 lbs. per 3,000 sq. ft.

The stencil sheet was subjected to thermal imaging tests, as described above, with the second layer in contact with an original and the first layer in contact with an absorbent tissue receiving sheet. A fair visible image, which was useful, was formed in the receiving sheet, by absorption of colored composition from the first layer. The original remained uncolored by the coloring material.

The quality of the stencil sheet image was rated good both when employing the Model 511 imager and when employing the Model 45CG imager. Also, improvements in latitude and speed of imaging were obtained, owing to the even or level surface on the second layer, which contacts the original.

EXAMPLE 3

A stencil sheet was prepared from the following heat-flowable compositions of thermoplastic film-forming material and plasticizing material partially but incompletely compatible with the film-forming material:

Composition 7

| Material | Parts by Weight | Parts by Volume |
|---|---|---|
| CAB 500-1 | 20.1 | 17.0 |
| Cumar R-9 | 22.0 | 19.4 |
| Univolt 33 | 38.0 | 42.0 |
| Brij 92 | 19.3 | 21.0 |
| DLTDP | 0.1 | 0.1 |
| BHT | 0.1 | 0.1 |
| Plastanox 425 | 0.2 | 0.2 |
| Citric Acid | 0.2 | 0.2 |
| Syloid 255 | 3.8 | |

Composition 8

| Material | Parts by Weight |
|---|---|
| CAB 500-1 | 20.0 |
| Cumar R-9 | 20.5 |
| Univolt 33 | 37.8 |
| Brij 92 | 16.6 |
| Castor Oil | 4.5 |
| DLTDP | 0.1 |
| BHT | 0.1 |
| Plastanox 425 | 0.2 |
| Citric Acid | 0.2 |

Composition 8 also contained 1.1 part by weight of Dianisidine Blue, to provide for application at a rate of 0.016 lb. per 3,000 sq. ft.

In this example, the base tissue sheet described in Example 1 was triple-coated, first to provide two layers of Composition 7 on the base sheet, and then to provide a layer of Composition 8 thereon. For the first layer, Composition 7 was incorporated in the solvent described above at a concentration of 22% by weight. For the second layer, the composition was incorporated in the solvent at a concentration of 32% by weight. The first two layers were coated on the base sheet in the manner described in Example 2, drying to the touch between layers and drying to below about 0.5% volatiles following application of the second layer. The second layer was applied so as to fill in the low areas on one surface of the first layer and provide an even or level surface on one side.

Composition 8 was applied as a third layer to the side of the first layer opposite to the side on which the second layer was applied. The third layer was applied and dried as described in Example 1 for the first layer thereof.

The coated weight of the sheet with the first layer applied thereto was 20 lbs. per 3,000 sq. ft., corresponding to 13.3 lbs. of composition deposited in the first layer per 3,000 sq. ft. The total coated weight of the sheet having the first and second layers thereon was 27.6 lbs. per 3,000 sq. ft., corresponding to 7.6 lbs. of composition deposited in the second layer per 3,000 sq. ft. The total coated weight of the sheet having three layers thereon was 29 lbs. per 3,000 sq. ft., corresponding to 1.4 lbs. of composition deposited in the third layer per 3,000 sq. ft., and a total amount of composition deposited on the base tissue sheet of 22.3 lbs. per 3,000 sq. ft.

The stencil sheet was subjected to thermal imaging tests, as described above, with the second layer in contact with an original and the third layer in contact with an absorbent tissue receiving sheet. The results were like those obtained employing the stencil sheet of Example 2, and the stencil sheet of this example had the additional advantages that substantially less pigment was required.

EXAMPLE 4

Similar results are obtained following the procedures of Examples 1–3 and employing the following heat-flowable composition of thermoplastic film-forming material and plasticizing material partially but incompletely compatible with the film-forming material in the respective coating layers, together with the coloring material in one of the layers on each sheet:

Composition 9

| Material | Parts by Weight | Parts by Volume |
|---|---|---|
| CAB 500-1 | 20.7 | 17.4 |
| Hercolyn D | 36.0 | 34.8 |
| Mobilsol L | 43.2 | 47.8 |

We claim:

1. An assembly for making an imaged stencil sheet and adapted to provide a visual index of the degree of imaging, said assembly comprising a thermographic stencil sheet, and a receiving sheet arranged for surface contact with said stencil sheet, said stencil sheet comprising:

an ink-pervious fibrous tissue base sheet having a weight of about 4½ to 12 lbs. per 2000 sq. ft., and at least two layers of a heat-flowable composition providing an ink-impervious coating on the base sheet, a first one of said layers being adapted for imaging contact with an original and said first layer being essentially colorless, and a second one of said layers being adapted for surface contact with said receiving sheet whereby said composition when rendered flowable by heat upon imaging transfers to the receiving sheet in the pattern of ink-transmitting image openings formed in the stencil sheet, said second layer containing pigment or dye coloring material in an amount sufficient to provide a visible index of the degree of imaging on said receiving sheet but insufficient to increase substantially the infrared absorptivity of the stencil sheet, said coloring material being present in a maximum amount of about 0.07 lb. per 3,000 sq. ft.

2. An assembly as defined in claim 1 wherein said receiving sheet is an absorbent fibrous tissue sheet.

3. An assembly as defined in claim 1 wherein said heat-flowable composition for each layer includes a thermoplastic film-forming material comprising a cellulose organic ester, and plasticizing material partially but incompletely compatible with said film-forming material.

4. An assembly as defined in claim 1 wherein said receiving sheet provides a contrasting background for said visible index while affording a viewability thereof with the assembly intact following imaging.

5. An assembly as defined in claim 1 wherein a legible image is formed on said receiving sheet by the colored composition when rendered flowable, the legibility of which correlates with the legibility of copy produced employing the imaged stencil sheet.

6. An assembly as defined in claim 1 having three layers of a heat-flowable composition providing said coating, said layers including an inner layer deposited first on said base sheet and two outer layers deposited on opposite sides of the inner layer, said inner layer and one outer layer being essentially colorless, said one outer layer being adapted for imaging contact with an original, and the remaining outer layer being adapted for contact with said receiving sheet and containing said coloring material.

7. An assembly as defined in claim 6 wherein the amounts of said composition contained in said layers are, in lbs. per 3,000 sq. ft., 10–15 lbs. in said inner layer, 6–12 lbs. in said one outer layer, and 1–3 lbs. in said remaining outer layer.

8. An assembly for making an imaged stencil sheet and adapted to provide a visual index of the degree of imaging, said assembly comprising a thermographic stencil sheet, and an absorbent fibrous tissue receiving sheet arranged for surface contact with said stencil sheet, said stencil sheet comprising:

an ink-pervious fibrous tissue base sheet having a weight of about 4½ to 12 lbs. per 2000 sq. ft., and at least two layers of a heat-flowable composition providing an ink-pervious coating on the base sheet, said composition for each layer including a thermoplastic film-forming material comprising a cellulose organic ester, and plasticizing material partially but incompletely compatible with said film-forming material, a first one of said layers being adapted for imaging contact with an original and said first layer being essentially colorless, and a second one of said layers being adapted for surface contact with said receiving sheet whereby said composition when rendered flowable by heat upon imaging transfers to the receiving sheet in the pattern of ink-transmitting image openings formed in the stencil sheet, said second layer containing pigment or dye coloring material in an amount sufficient to provide a legible image on said receiving sheet but insufficient to increase substantially the infrared absorptivity of the stencil sheet, said coloring material being present in a maximum amount of about 0.07 lb. per 3,000 sq. ft., the legibility of said image correlating with the legibility of copy produced employing the imaged stencil sheet, said receiving sheet providing a contrasting background for said image while affording viewability thereof with the assembly intact following imaging.

9. An assembly as defined in claim 8 wherein said coloring material is present in an amount of about 0.015 to 0.07 lb. per 3,000 sq. ft.

10. An assembly as defined in claim 9 wherein said coloring material is Dianisidine Blue pigment.

11. An assembly as defined in claim 8 having three layers of a heat-flowable composition providing said coating, said layers including an inner layer deposited first on said base sheet and two outer layers deposited on opposite sides of the inner layer, said inner layer and one outer layer being essentially colorless, said one outer layer being adapted for imaging contact with an original, and the remaining outer layer being adapted for contact with said receiving sheet and containing said coloring material.

12. An assembly for making an imaged stencil sheet and adapted to provide a visual index of the degree of imaging, said assembly comprising a thermographic stencil sheet, and an absorbent fibrous tissue receiving sheet arranged for surface contact with said stencil sheet, said stencil sheet comprising:

an ink-pervious fibrous tissue base sheet having a weight of about 4½ to 12 lbs. per 3,000 sq. ft., and two layers of a heat-flowable composition providing an ink-impervious coating on the base sheet, said composition for each layer including a thermoplastic film-forming material comprising a cellulose organic ester, and plasticizing material partially but incompletely compatible with said film-forming material, a first one of said layers being adapted for imaging contact with an original and said first layer being essentially colorless, and a second one of said layers being adapted for surface contact with said receiving sheet whereby said composition when rendered flowable by heat upon imaging transfers to the receiving sheet in the pattern of ink-transmitting image openings formed in the stencil sheet, said second layer being deposited on said base sheet in an amount of about 10–15 lbs. of said composition per 3,000 sq. ft., said first layer being deposited on said second layer in an amount of about 6–12 lbs. of said composition per 3,000 sq. ft., and the total amount of heat-flowable composition in said layers being about 18–23 lbs. per 3,000 sq. ft., said second layer containing pigment or dye coloring material in an amount sufficient to provide a legible image on said receiving sheet but insufficient to increase substantially the infrared absorptivity of the stencil sheet, said coloring material being present in a maximum amount of about 0.07 lb. per 3,000 sq. ft., the legibility of said image correlating with the legibility of copy produced employing the imaged stencil sheet.

13. An assembly for making an imaged stencil sheet and adapted to provide a visual index of the degree of imaging, said assembly comprising a thermographic stencil sheet, and an absorbent fibrous tissue receiving sheet arranged for surface contact with said stencil sheet, said stencil sheet comprising:

an ink-pervious fibrous tissue base sheet having a weight of about 4½ to 12 lbs. per 3,000 sq. ft., and three layers of a heat-flowable composition providing an ink-impervious coating on the base sheet, said layers including an inner layer deposited first on said base sheet and first and second outer layers deposited on opposite sides of the inner layer, said composition for each layer including a thermoplastic film-forming material comprising a cellulose organic ester, and plasticizing material partially but incompletely compatible with said film-forming material, said inner layer and said first outer layer being essentially colorless, said first outer layer being adapted for imaging contact with an original, said second outer layer being adapted for surface contact with said receiving sheet whereby said composition when rendered flowable by heat upon imaging transfers to the receiving sheet in the pattern of ink-transmitting image openings formed in the stencil sheet, said inner layer being deposited in an amount of about 10–15 lbs. of said composition per 3,000 sq. ft., said first outer layer being desposited in an amount of about 6–12 lbs. of said composition per 3,000 sq. ft., said second outer layer being deposited in an amount of about 1–3 lbs. of said composition per 3,000 sq. ft., and the total amount of heat-flowable composition in said layers being about 19–26 lbs. per 3,000 sq. ft., said second outer layer containing pigment or dye coloring material in an amount sufficient to provide a legible image on said receiving sheet but insufficient to increase substantially the infrared absorptivity of the stencil sheet, said coloring material being present in a maximum amount of about 0.07 lb. per 3,000 sq. ft., the legibility of said image correlating with the legibility of copy produced employing the imaged stencil sheet.

* * * * *

UNITED STATES PATENT AND TRADEMARK OFFICE

CERTIFICATE OF CORRECTION

PATENT NO. : 4,074,003

DATED : February 14, 1978

INVENTOR(S) : Margery L. Schick et al.

It is certified that error appears in the above—identified patent and that said Letters Patent is hereby corrected as shown below:

Column 4, line 52, "Dianisiline" should read -- Dianisidine --.

Signed and Sealed this

Twenty-second Day of December 1981

[SEAL]

Attest:

GERALD J. MOSSINGHOFF

Attesting Officer

Commissioner of Patents and Trademarks